United States Patent [19]

Kagawa

[11] 4,343,171

[45] Aug. 10, 1982

[54] APPARATUS FOR MANUFACTURING A SLAT FOR A SHUTTER

[75] Inventor: Tokiyoshi Kagawa, Tokyo, Japan

[73] Assignee: Sanwa Shutter Corporation, Tokyo, Japan

[21] Appl. No.: 154,128

[22] Filed: May 29, 1980

[30] Foreign Application Priority Data

May 7, 1980 [JP] Japan ..... 55-59483

[51] Int. Cl.[3] ..... B21B 15/00

[52] U.S. Cl. ..... 72/181; 72/177

[58] Field of Search ..... 72/177, 181

[56] References Cited

U.S. PATENT DOCUMENTS 3,150,707 9/1964 Howell ..... 72/177
3,264,724 8/1966 Griesser .
3,690,137 9/1972 Cookson .
3,886,779 6/1975 McClain .
4,020,666 5/1977 Beymer ..... 72/177
4,027,517 6/1977 Bodnar .
4,047,417 9/1977 Oser et al. .
4,059,000 11/1977 Bodnar .
4,092,842 6/1978 Oser et al. .
4,145,905 3/1979 Mattie .
4,154,077 5/1979 Cotter .

*Primary Examiner*—Leon Gilden
*Attorney, Agent, or Firm*—Spencer & Kaye

[57] ABSTRACT

A cold roll forming apparatus for forming a slat for a shutter having forming rolls successively disposed along a path line of the material and a pattern embossing roll disposed along the path line is shown. Metal band sheet fed through the apparatus is formed into a predetermined slat configuration and simultaneously repeated patterns are embossed on the flat surface of the slat.

4 Claims, 9 Drawing Figures

APPARATUS FOR MANUFACTURING A SLAT FOR A SHUTTER

BACKGROUND OF THE INVENTION

This invention relates to an apparatus for manufacturing slats for a shutter on the surface of which ribs or other embossing patterns or shapes are applied by using an embossing roll for forming the patterns on the surface of the slat to be used for a shutter.

It is well known that metal band sheet may be formed into the configuration of a slat of a shutter by cold roll forming, as in U.S. Pat. No. 3,264,724 issued on Aug. 9, 1966.

In such a cold roll forming apparatus, a number of forming roll members each composed of an upper roll and a lower roll are disposed along a path line of the material and the material fed through these roll members are gradually formed into the configuration of a slat for a shutter.

It has been desired to provide patterns on the surface of such a slat, in order to improve the appearance and the strength of the slat. And for this purpose, metal band sheet already embossed by steel band manufacturers may be used and the material may then be formed into a slat configuration in a cold roll forming apparatus. However, not only has it been difficult to obtain metal bands having the desirable patterns, but there is the problem that the patterns such as ribs still remain in the interlocking part of the slats, which prevents smooth movement between linked slats when winding the shutter. When the slats are wound around a shutter winding drum, slats are piled around and the surfaces of the slats rub against each other, which results in wearing of the coating on the surface of the slats. Therefore, it has been difficult to form embossing patterns on the surface of a slat.

Therefore, it is an object of this invention to provide an apparatus for manufacturing a slat for a shutter having embossing patterns as ribs on a desired part of the surface of the slat.

SUMMARY OF THE INVENTION

In order to implement the above and other objects of this invention, the present invention uses the conventional roll forming apparatus and an embossing roll is additionally inserted in the apparatus so as to form desired patterns on the surface of a slat at the desired forming stage of the material. Therefore, the forming of the patterns on the slat surface may be made with the forming process of the slat configuration.

BRIEF DESCRIPTION OF THE DRAWINGS

Other features, objects and advantages of the present invention will become apparent by the following description with reference to the attached drawings in which.

DESCRIPTION OF THE PREFERRED EMBODIMENT

Figure 1:
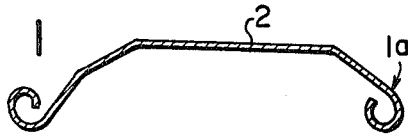
FIG. 1 is an explanatory view of a slat whose central surface is almost flat.
Figure 2:
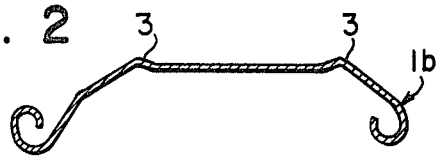
FIG. 2 is another explanatory view of a slat whose central surface further has longitudinal ribs.
Figure 3:
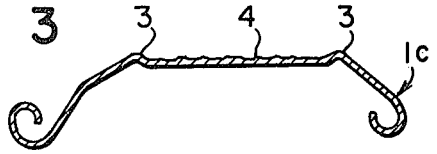
FIG. 3 is a view of a slat of an embodiment of this invention having additional patterns between the side ribs shown in FIG. 2.

In FIGS. 1–3, there are shown slats 1*a*, 1*b* and 1*c*, whose both edges are bent so as to enable interlocking with other slats in a completed shutter. The central surface of the slat in FIG. 1 is almost flat. In FIG. 2, continuous and longitudinal ribs 3 are formed in parallel with each other. These longitudinal ribs 3 will strengthen the slat.

Figure 4:
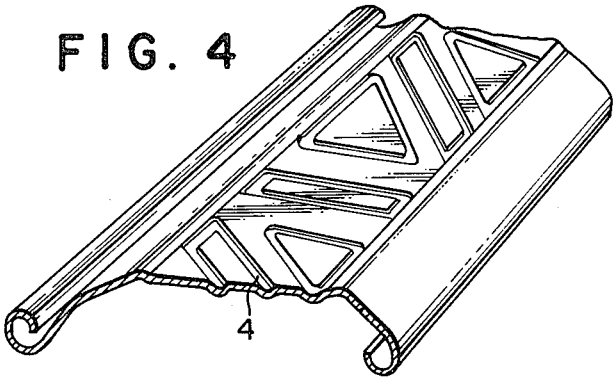
FIG. 4 is a view showing an example of patterns formed in the central flat surface of the slat according to the apparatus of this invention.
Figure 5:
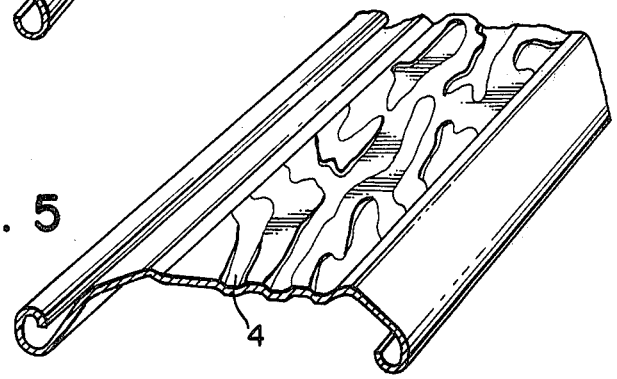
FIG. 5 is a view showing another example of patterns formed in the slat by the apparatus of this invention.

In FIG. 3, further embossing patterns 4 are provided between both ribs 3. It will be realized therefore that the ribs 3 form a concave surface therebetween and this concave surface at the central portion of the slat prevents any damage to the patterns when a shutter is wound around the shutter winding drum. The patterns embossed in the central portion of the slats may be ribs or any other patterns. In FIG. 4, the patterns provided are ribs 4 protruded downwardly in the figure, and in FIG. 5, there are shown texturized patterns 4.

The present invention can form any slat configuration such as FIGS. 1, 2 and 3 through the conventional roll forming apparatus by preparing various rolls. For example, an embossing roll member for forming the patterns shown in FIGS. 3–5 or that for the ribs 3 may be included in the apparatus or both of them may be included and used together. In the apparatus according to this invention, the necessary embossing rolls may be mounted already in the apparatus, so that when the rolls for ribs 3 and patterns 4 are mounted, the slat formed by the apparatus may at first take the configuration of FIG. 1 at the first stage, and then take the configuration of FIG. 2 at the next stage by the embossing roll for the ribs 3. Then the slat may finally be formed with the patterns 4 by the roll for such patterns as shown in FIG. 3.

Figure 7:
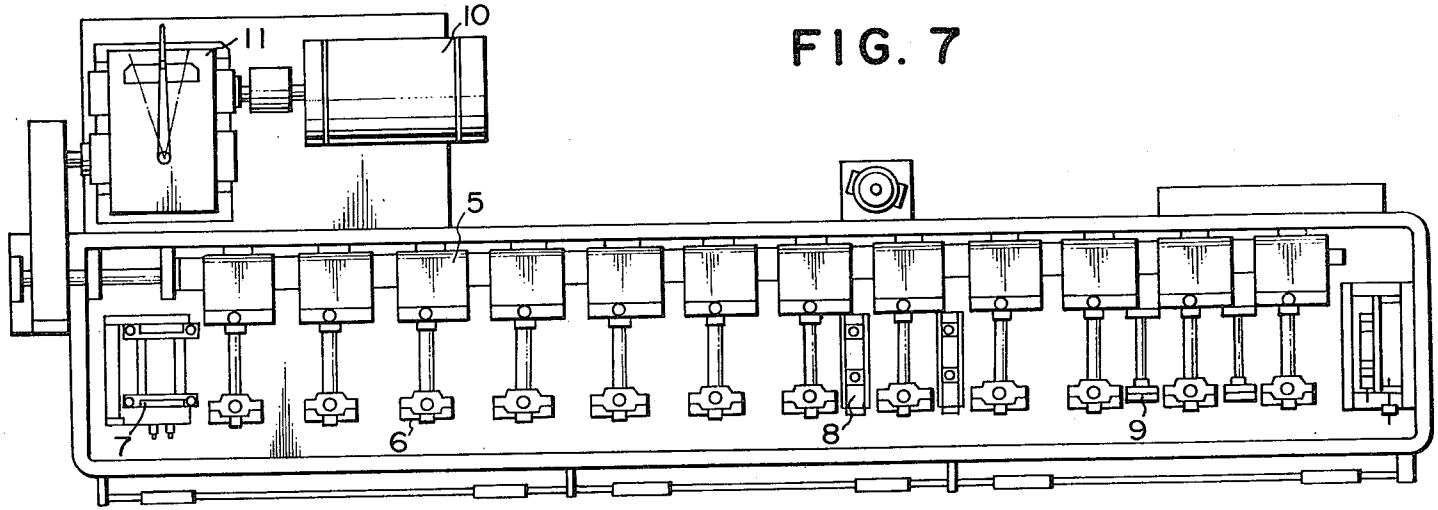
FIG. 7 is a plan view of the apparatus of FIG. 6.
Figure 6:
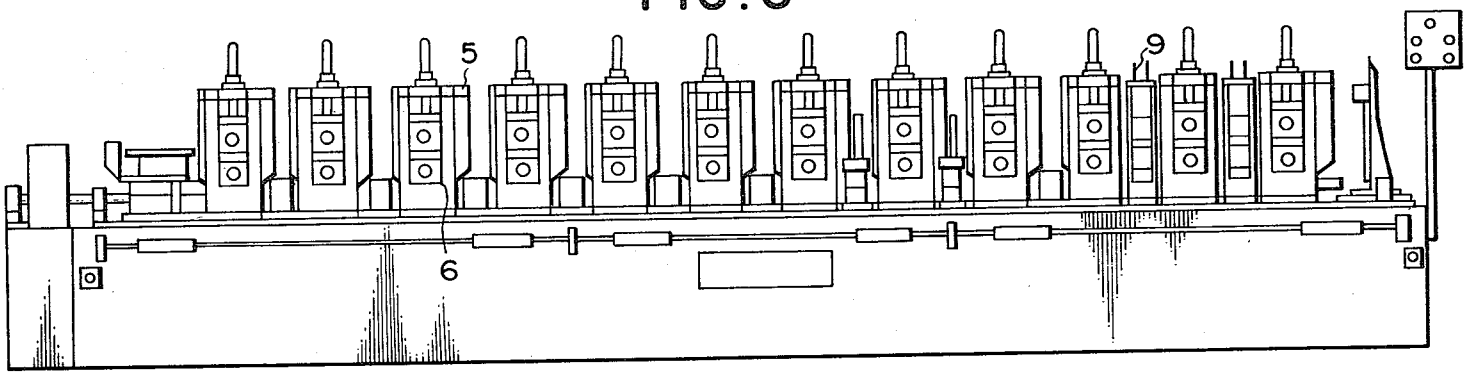
FIG. 6 is a side view of an embodiment of a roll forming apparatus according to this invention.

In the roll forming apparatus shown in FIGS. 6 and 7, the numeral 5 is a drive housing and the numeral 6 denotes an outboard housing, between which a main roll member 12 (FIG. 8) for forming a slat (not shown) is mounted. The numeral 7 in the figures is an inlet guide stand for metal band material, and 8 is a side roll stand. The numeral 9 is a stand for an auxiliary roll member. The numeral 10 is a motor and the main roll members are driven by this motor 10 through a transmission 11. The drive housings 5 receive power from a common driving shaft through gears provided in the respective housings 5.

A band material of a determined width is fed through the apparatus to form a slat in a continuous manner. The formed slat is cut into a desired length with a cutter, not shown. The cut slats are then connected respectively at the interlocking parts thereof with other slats so as to provide a shutter curtain.

Figure 8:
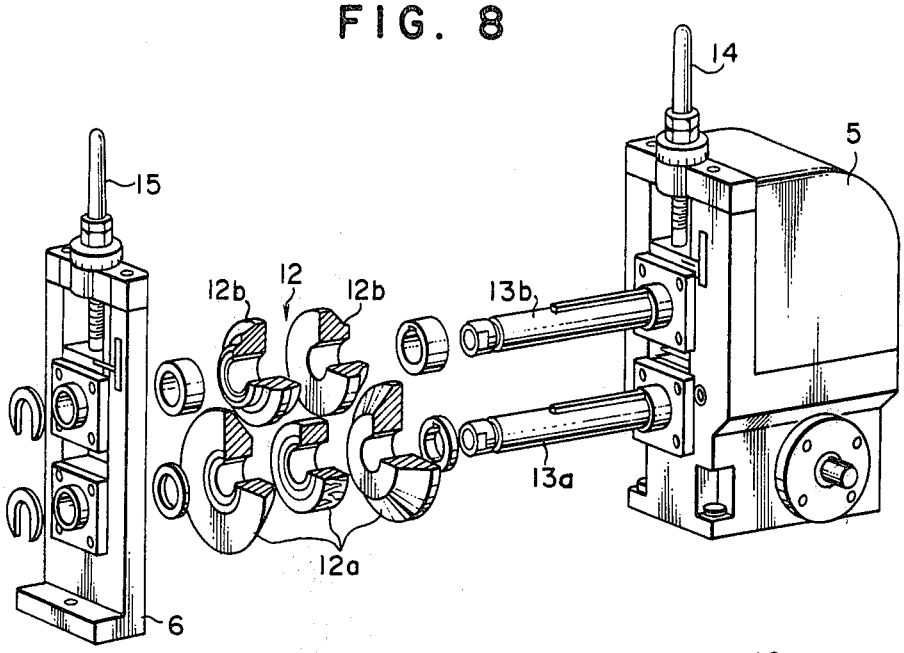
FIG. 8 is a perspective view, in a partly exploded form, of a main roll member including a pattern embossing portion the member being inserted in the apparatus.
Figure 9:
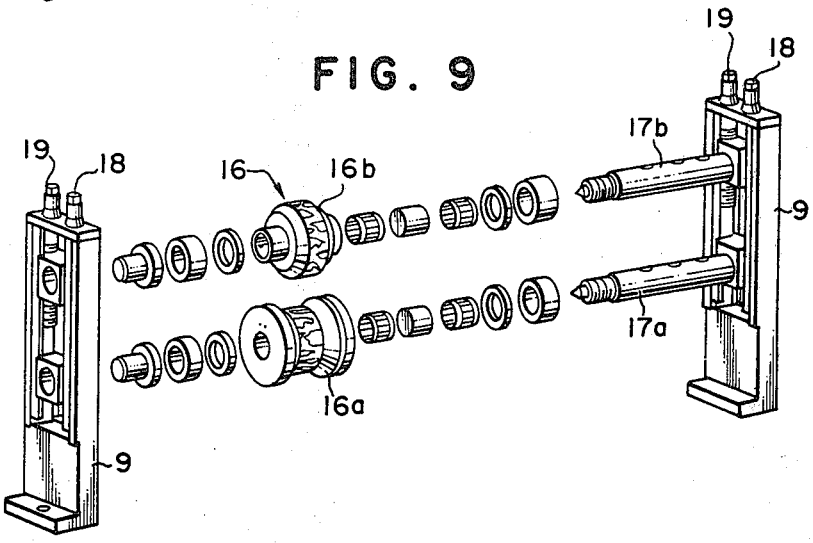
FIG. 9 is a perspective view, partly exploded, of an auxiliary roller member inserted in the apparatus, the member including a pattern embossing portion.

Both the main roll member and the auxiliary roll member may comprise an upper roller and a lower roller, and they may be in an integral or separate member. The separate type of the main roll member 12 is shown in FIG. 8 and the integral auxiliary roll member 16 is shown in FIG. 9. The separate elements of the roll are formed into a roll by clamping, etc. This separate type has a lower production cost than the former integral type, because the patterns may only be embossed in a single roll element of the roll. For example, a roll element for forming the almost flat intermediate portion 2 (see FIG. 1) may only be replaced with other element for forming desired patterns.

The upper and lower roll shafts are connected to the driving source and the upper rolls may be respectively moved upward when not to be used. Therefore, plural embossing rolls may be included in the apparatus and the upper roll not to be used may only be lifted and removed from the path line. The metal band only slips on the lower rolls and no patterns are formed on their surface.

If there is any concave or convex pattern in the rolls, a difference arises in the circumferential velocity of the rolls, and a good surface finish on the slat may not be obtained. Therefore the forming rolls for the desired patterns are capable of relative rotation. In other words, in the case of the main roll member the gear connected with the driving source can be removed and may be rotated only by frictional power.

The roll forming apparatus generally includes only the main roll members, or alternatively, a single roll member or a plurality of auxiliary roll members are inserted between the main roll members or next to the final main roll member.

Conventionally, the auxiliary roll member in the roll forming apparatus is inserted thereinto for correcting the warping of the material under forming or preventing any displacement of the center position of the material. For example, a roll forming apparatus for forming a special sectional pattern cannot be used for forming another shape because additional stages must be prepared. Therefore, desired auxiliary roll members of generally shorter diameter are added between the main roll members in order to add stages to obtain a better result. The auxiliary roll members are not driven and also both the upper and lower rolls thereof may be made removable from the path line of the material upwardly and downwardly, respectively.

According to a further embodiment of this invention, the auxiliary roll member for forming the desired patterns may be inserted between the main roll members (as shown in FIG. 9), instead of such forming main roll member. The upper and lower rolls of this auxiliary roll member can be removed from the path line upwardly and downwardly respectively, as already explained. When this auxiliary roll member is not used, therefore, the slat material can be fed without contacting the auxiliary roll member.

Either the upper roll or the lower roll of the pair consisting of the main roller member and auxiliary roll member may be etched or engraved for forming the ribs or other patterns, and the other roll may be made of hard urethane or hard rubber. In such a case, the slat material is fed between the rolls and patterns can be formed on the surface thereof. If forming is not required on the slat, the upper roll may only be shifted.

With reference to FIG. 8, a main roll member 12 is supported on two roll shafts 13*a* and 13*b* provided between the drive housing 5 and the outboard housing 6. As is clear from FIG. 8, the main roll member 12 is composed of a pair consisting of a lower roll 12*a* and an upper roll 12*b*, each of which is composed of separate roll elements. In the main roll member 12, necessary forming is effected to form the desired patterns in the slats. If it is desired that such patterns not be formed in a slat, the rolls may be removed from the line by adjusting screws 18 and 19. In FIG. 8, the numerals 14 and 15 identify adjusting screws to adjust the distance between the upper and lower rolls.

In FIG. 9, an auxiliary roll member 16 is rotatably mounted on two roll shafts 17*a* and 17*b* which are supported between auxiliary roll stands 9 and 9. The auxiliary roll member 16 is not driven. In other words, it rotates at a circumferential velocity naturally determined by the flow of the material due to the frictional power between the material and rolls. In the embodiment disclosed, the lower roll 16*a* and the upper roll 16*b* are formed in an integral form respectively. But these rolls 16*a* and 16*b* may be formed as divided roll elements, as the main roll member of FIG. 8. The numeral 18 is an adjusting screw for adjusting the upward or downward movement of a lower roll shaft 17*a*, and the numeral 19 is an adjusting screw for an upper roll shaft 17*b*. With these adjusting screws 18, 19 it is possible to remove the upper and lower rolls 16*a* and 16*b* from the path line or to adjust the space between the upper and lower rolls.

As is mentioned above, according to the present invention the conventional roll forming apparatus can be used and an embossing roll may only be treated to have desired patterns to provide a slat of good design. This special roll may be inserted in place of the main roll member or the auxiliary roll member in the roll forming apparatus at any stage of the process, most desirably at the later stage of the process. The desired pattern is formed simultaneously with the forming of the ordinary slat. Particularly, the slat with both ribs 3 and patterns 4 may be produced simply by the apparatus. Thus the present invention provides stronger and well designed shutter slats at a low cost.

Since the slat made according to this invention is superior in strength, the width of the slat can be made larger than the conventional slat, which results in an improvement of the manufacturing efficiency. Also, material may be saved and the efficiency of the manufacturing operation may be improved. Its effect is most important in the manufacture of a shutter.

According to the present invention, a slat with the longitudinal ribs on both sides as in FIG. 2 may be manufactured easily. This provides not only the improvement in design and strength, but also the following feature: That is, at the time of winding the shutter around the upper winding drum, the slats rotate with respect to each other at the interlocking parts and the slats contact each other. By the existence of ribs, contact pressure between the surfaces of the slat is lowered so as to prevent any damage or removal of the coating.

The material used in the manufacture of slats is band steel, and this material may be easily obtained at a relatively low cost.

The foregoing detailed description has been given for clearness of understanding only, and no unnecessary limitations should be understood therefrom, as modifications will be obvious to those skilled in the art.

What is claimed is:

1. An apparatus for manufacturing a slat for a shutter, said slat having longitudinal ribs, comprising:

a plurality of forming rolls comprising stages successively disposed along the path line of a metal sheet to form the metal sheet into a predetermined slat configuration; and a pair of pattern embossing rolls, having upper and lower driving shafts, disposed along said path line at the last of said stages, at least one of said pattern embossing rolls having embossing patterns thereon to produce corresponding patterns on a surface of said slat, the patterns being formed on the flat surface provided between the longitudinal ribs of said slat, said upper and lower driving shafts of the pattern embossing rolls being rotated only by the slat passing therebetween.

2. An apparatus according to claim 1, wherein each of the pattern embossing rolls is in an integral form and a part of the integral form has embossing patterns thereof.

3. An apparatus according to claim 1, wherein the pattern embossing roll is formed of separate elements and the embossing patterns are formed in an element of the roll.

4. An apparatus according to claim 1, wherein one of the pair of pattern embossing rolls has the embossing patterns and the other roll is made of a material selected from hard urethane and hard rubber.

* * * * *